United States Patent [19]

Davey et al.

[11] 4,123,377

[45] Oct. 31, 1978

[54] PARTICULATE DETERGENT COMPOSITION CONTAINING DIBASIC MAGNESIUM HYPOCHLORITE

[75] Inventors: Christopher R. Davey, Fairfield; Peter J. Buckley, Cincinnati, both of Ohio

[73] Assignee: The Procter & Gamble Company, Cincinnati, Ohio

[21] Appl. No.: 827,759

[22] Filed: Aug. 25, 1977

[51] Int. Cl.[2] ..... C11D 7/56

[52] U.S. Cl. ..... 252/103; 252/95; 252/99; 252/187 H; 423/473; 423/474

[58] Field of Search ..... 252/95, 99, 103, 187 H; 8/108 R; 423/473, 474

[56] References Cited

U.S. PATENT DOCUMENTS

| | | | |
|---|---|---|---|
| 2,097,517 | 2/1937 | Durgin | 252/99 |
| 3,446,893 | 5/1969 | Hanford et al. | 252/99 X |
| 3,582,265 | 6/1971 | Bishop et al. | 252/103 X |

*Primary Examiner*—Mayer Weinblatt

*Attorney, Agent, or Firm*—Robert B. Aylor; Richard C. Witte; Thomas H. O'Flaherty

[57] ABSTRACT

A particulate detergent composition containing dibasic magnesium hypochlorite having a specific small particle size as the bleaching agent.

27 Claims, 1 Drawing Figure

EFFECT OF PARTICLE SIZE ON SOLUBILITY OF DBMgH

PARTICULATE DETERGENT COMPOSITION CONTAINING DIBASIC MAGNESIUM HYPOCHLORITE

BACKGROUND OF THE INVENTION

The instant invention is related to the use of small particle size dibasic magnesium hypochlorite as a bleaching agent in a particulate detergent composition. The composition shows greater cleaning performance due to the presence of the bleaching agent containing more available chlorine than conventional hypochlorite bleaching agents and having good solubility characteristics.

Hypochlorites have been used as bleaching agents for a long period of time. Hypochlorite ion, when free and available in solution, provides good cleaning performance. A problem existed in finding a hypochlorite material which had more than 50% available chlorine while maintaining prolonged stability. In the prior art, calcium hypochlorite had become the preferred hypochlorite even though its stability was not good when mixed with a particulate detergent composition. Also it is known to produce pinholes in fabrics.

U.S. Pat. No. 3,582,265, issued June 1, 1971 to Bishop et al., assigned to Olin Corporation, discloses a novel process for the production of dibasic magnesium hypochlorite and claims the compound. The Bishop et al. patent discloses that dibasic magnesium hypochlorite is a good bleaching agent but does not disclose the extent to which the release and rate of release of hypochlorite ions in solution depend on the size of the initial particles.

It is, therefore, an object of this invention to provide the critical parameters of particle size needed to make dibasic magnesium hypochlorite an effective bleaching agent in particulate detergent compositions.

The way in which this object is achieved will become apparent from the following disclosure.

All percentages, parts, and ratios used herein are by weight unless otherwise specified.

SUMMARY OF THE INVENTION

The present invention relates to the use of dibasic magnesium hypochlorite having a particle diameter of less than about 88 microns, preferably less than 44 microns, more preferably less than 10 microns, in a particulate detergent composition. The invention involves the use of dibasic magnesium hypochlorite as a bleaching agent while carefully controlling the size of the bleaching agent particles.

DETAILED DESCRIPTION OF THE INVENTION

Figure 1:
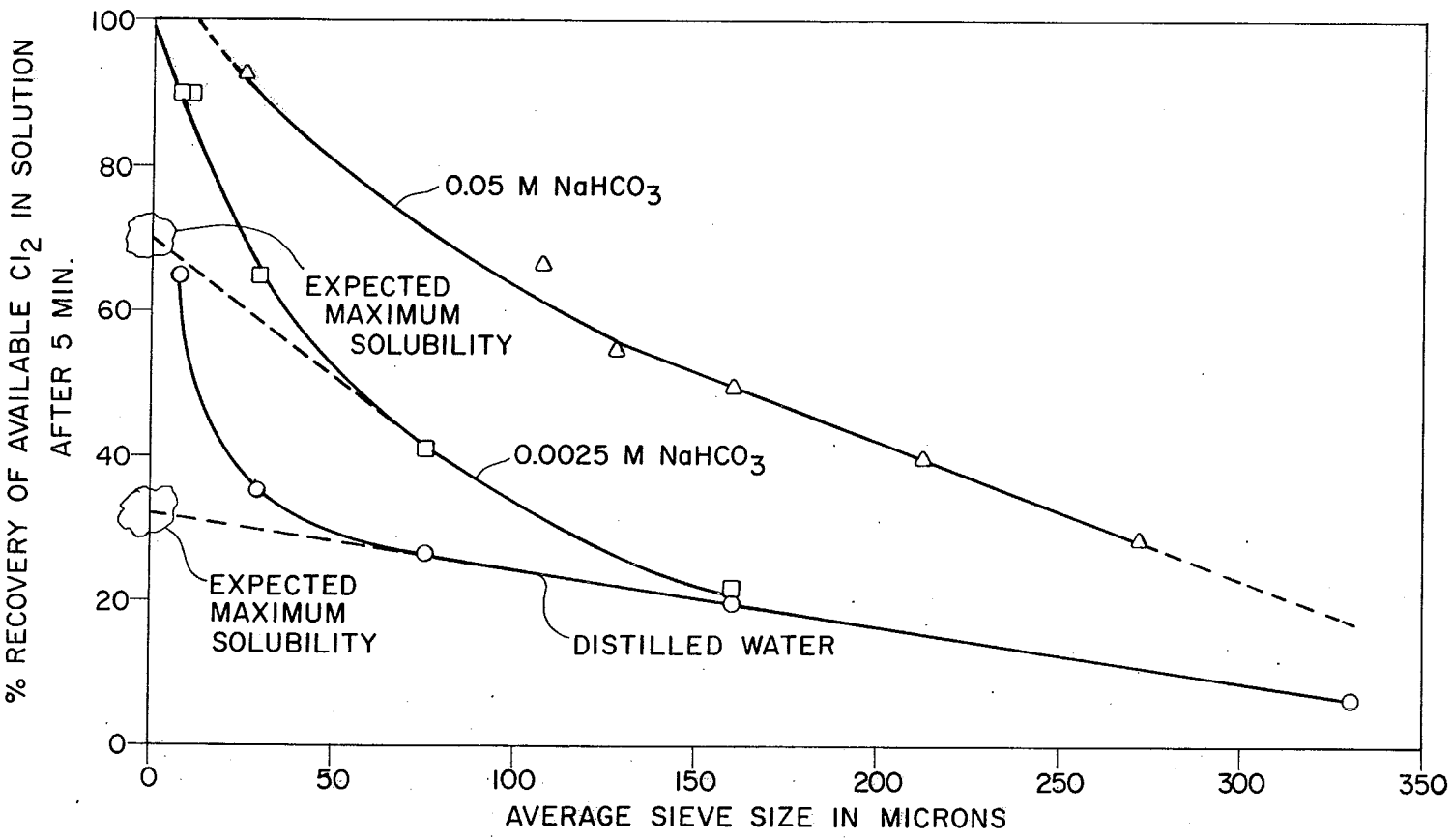

The instant invention comprises two components, optionally four components. The first of these is an organic detergent surfactant, e.g., a water soluble synthetic detergent selected from the group consisting of anionic, nonionic, zwitterionic and ampholytic detergents and mixtures thereof. The second, but optional component, is a detergent builder. The third component is the dibasic magnesium hypochlorite. The last, but optional component, is a buffering agent.

The bleaching agent used in the particulate detergent composition is dibasic magnesium hypochlorite. Dibasic magnesium hypochlorite (DBMgH) is preferred over ordinary solid hypochlorite bleaches due to the presence of approximately 50% available chlorine and good stability on the shelf when mixed in a particulate detergent composition.

It is well documented in the hypochlorite literature that hypochlorites are good bleaching agents. However, solid hypochlorites were not widely used until calcium hypochlorite was discovered. Calcium hypochlorite is known to have fair shelf stability and solubility, but it can produce pinholes in fabrics. Though having fair shelf stability, calcium hypochlorite still loses a large percentage of its available chlorine prior to use when mixed with a particulate detergent. The problem led to attempts to make magnesium hypochlorite compositions.

A basic magnesium hypochlorite was reported by Nozaki et al. in a Japanese publication abstracted in *Chemical Abstracts,* 48, 1413F (1954). The compound was attributed the formula $$Mg(OH)\ (OCl.Mg(OH)_2).2H_2O$$

This tribasic magnesium compound has 40% available chlorine. A "magnesium bleaching powder" having a maximum available chlorine of 44% has been reported by Fu Kasawa in a publication abstracted in *Chemical Abstracts,* 62, 3666f (1965). The dibasic magnesium hypochlorite, containing from 52 to 60% available chlorine, was disclosed in U.S. Pat. No. 3,582,265, June 1, 1971, to Bishop et al., assigned to Olin Mathieson, incorporated herein by reference.

The dibasic compound was found to be superior to calcium hypochlorite either when used alone or when admixed with various detergent builders as disclosed by the Bishop et al. patent at column 5, lines 20–25. The release rate of DBMgH in solution is slower than calcium hypochlorite giving a better sanitizing effect. Dibasic magnesium hypochlorite, unlike some other bleaching agents, does not produce pinholes in fabrics thus making DBMgH a good textile bleaching agent.

Dibasic magnesium hypochlorite is available in commerce being sold only by Olin Chemicals. Commercially, DBMgH is sold with a nominal particle size (diameter) of 160 microns and a distribution of sizes ranging from 2 microns to 330 microns. Olin claims that this DBMgH as sold is readily soluble. Suprisingly, applicants have found, while searching for a bleaching agent with approximately 50% available chlorine, which could be used in a 10 minute wash cycle, that the nominal size particles in a 10 minute wash cycle, that the nominal size particles sold by Olin are not readily soluble. Applicants found that particles of 160 microns nominal size gave only a 20% recovery of available chlorine in five minutes when the target was 50 ppm of available chlorine.

Stock 160 micron dibasic magnesium hypochlorite particles in distilled water gave a 20% recovery of available chlorine after 5 minutes. Allowing the distilled water solution containing the nominal 160 micron particles to sit an additional 3½ hours only gave 50% recovery of the available chlorine. This would lead to the belief that the reaction had reached equilibrium with the maximum recovery of $AvCl_2$ (available chlorine) being only 50% of theoretical in solution. A particle showing that characteristic is not readily soluble, or at least not for textile bleaching purposes.

When the particle size was reduced via crystallization techniques or by grinding processes to an average size of less than about 45 microns in diameter, there was a 55–65% recovery of the available chlorine under the same conditions as with the five minute test above with the 160 micron particle. In the commercial grade of DBMgH sold by Olin it was found that only 0.14% of the particles were in the range of less than 10 microns and only 20% in the range of less than 88 microns. The Bishop et al. patent does not disclose any particle size (diameter) nor whether size is critical to good bleaching performance.

It is known, in general, that reduced particle size increases the surface area and thus rate of solubility; however, given the results of the solubility test using 160 micron particles, the results found by the applicants were unexpected. Under normal circumstances, a plot of the solubility of other solid bleaches as a function of size of the particles would give a linear plot. Applicants have found that when DBMgH particles are in the nominal 10 microns range in size, the rate of solubility of DBMgH is greatly increased above that expected, in fact it approached maximum solubility in terms of release of available chlorine. These tests were carried out in distilled water. The FIG. shows this result after 5 minutes in solution. A deviation from expected solubility based on the 160μm particles beings at roughly 88 microns followed by another major deviation at 45 microns with the largest deviation occurring at lesss than 10 microns. Applicants have found, surprisingly, that it is the size of the particle which controls both the solubility and rate of release of the available chlorine and this is the basis of their invention. The Bishop et al. patent failed to realize that the size of the DBMgH particles was critical. Apparently, surface area is not the only critical parameter since the 160 micron particles did not release all of their available chlorine even upon long standing times.

The Bishop et al. patent discloses eight examples for making dibasic magnesium hypochlorite, but no example of a detergent composition. However, the Bishop et al. patent neither discloses a particle size nor claims any. It is the applicants who have found that particle size is critical for effective cleaning performance.

The reduced particle size has the advantage of making dry admixing to form a composition easier, surprisingly without the potential for segregation found when using the larger particles. Crumbling of the smaller size particles is not a problem. In performance testing, it was found that the smaller particles (nominal 45 microns diameter and smaller region) gave better cleaning in relation to perborate bleaches than the larger particles. The smaller particle size has the additional advantage that the increased rate of solubility leads to less pinholes. The lack of pinholing is due to a smaller particle being deposited on the fabric for a shorter period of time as compared to the larger less readily soluble particles.

The above advantages show the criticality of the particle size. Applicants have found that control of this parameter is required to make dibasic magnesium hypochlorite an effective cleaning agent.

Particles of less than 10 microns in diameter give the best cleaning performance with a good practical range being 6–12 microns. Good performance was observed up to 45 microns. However, above 45 microns, in a nonbuffered system, the cleaning performance was not as good as at the smaller particle sizes. The graph depicting solubilities verifies the above as the first major deviation from the expected solubility did occur at roughly 45 microns.

In relation to other hypochlorites (e.g., lithium hypochlorite, calcium hypochlorite), the smaller particle size dibasic magnesium hypochlorite's storage stability is good in a particulate detergent composition. When calcium hypochlorite or lithium hypochlorite is added to water, complete solubility takes place in less than a minute, whereas the solubility of the smaller particle size dibasic magnesium hypochlorite was at a slightly slower rate which is more suitable for use in a 10 minute wash.

Dibasic magnesium hypochlorite is pH sensitive and is insoluble at a pH over 10.5. The pH range for best performance is 8.0 to 9.6 with the preferred being 8.5 to 9.5 The detergent composition in which it is used must operate at a pH below about 10.5.

An additional optional agent which may be used to aid in giving good bleaching performance include pH adjustment agents. The typical pH adjustment agents are used to buffer the composition so as to have an initial pH in solution of 8–10, especially the 8.0–9.5 range where the DBMgH bleaching agent is most useful. A normal detergent composition containing DBMgH has a pH of near 9 and on going into a solution DBMgH raises the pH above 10.5 at which point DBMgH becomes insoluble reducing the cleaning performance expected. Having buffered the composition to a pH of about 8.5 allows the wash to take place in a range most beneficial to the use of DBHgH as a bleaching agent.

Conventional buffering agents are useful in the composition. Examples of preferred buffering agents include sodium bicarbonate and borax/hydrochloric acid. Buffering agents found not to work include borax/caustic soda, sodium carbonate, and potassium dihydrogen phosphate.

When buffering agents were used it was found that the size of particles which were readily soluble could be as large as 88 microns as compared to an unbuffered solution in which the particle size boundary is less than 45 microns. At particle sizes less than 10 microns the effect of the buffering agent was absent as the drawing illustrates. The solubility of the less than 10 micron particle of DBHgH approaches the solubility of a buffered solution and, in fact, reaches the expected solubility of a buffered solution containing sodium bicarbonate (0.0025N), the most preferred buffering agent.

Buffered solutions offer not only the utility of being able to use larger particles, but the added advantage of placing the initial solution in the proper preferred pH range to make DBMgH a more effective bleach.

The bleaching compositions as described above can be added to and made a part of conventional fabric laundering detergent compositions. Accordingly, the instant detergent bleaching compositions include such standard detergent adjuvants as surfactants and builders. Surfactants are selected from the group consisting of organic anionic, nonionic, ampholytic and zwitterionic surfactants and mixtures thereof. Optional, but preferred builder materials, include any of the conventional organic builder salts including carbonates, silicates, acetates, polycarboxylates, and phosphates. If the instant bleaching compositions are employed as part of a conventional fabric laundering detergent composition, the instant bleaching particles generally comprise from about 1 to about 50% by weight of such conventional detergent compositions.

The instant bleach compositions contain from about 5% to about 99% by weight of conventional surfactant and builder materials. Further examples of suitable surfactants and builders are given below.

Water-soluble salts of the higher fatty acids, i.e., "soaps," are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammmonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$–$C_{18}$ carbon atoms) produced by reducing the glycerides of tallow or coconut oil, sodium and potassium $C_8$–$C_{20}$ paraffin sulfonates, and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil, sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 10 to 20 carbon atoms in the alkyl group and from about 1 to 30 moles of ethylene oxide; water-soluble salts of olefin sulfonates containing from about 12 to 24 carbon atoms; and $\beta$-alkoxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures. Mixtures of anionic surfactants which can be used in the present detergent compositions can be taken from the sodium and potassium alkyl sulfates, especially those obtained by sulfating the higher alcohols ($C_8$–$C_{18}$ carbon atoms) produced by reducing the glycerides of tallow or coconut oil, sodium and potassium $C_8$–$C_{20}$ paraffin sulfonates, sodium and potassium alkyl benzene sulfonates, in which the alkyl group contains from about 9 to about 15 carbon atoms in straight chain or branched chain configuration, and the sodium salt of a sulfated condensation product of tallow alcohol with from about 2 to about 10 moles of ethylene oxide.

Nonionic surfactants include the water-soluble ethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein. Care should be used when alkali ethoxylated alkyl sulfates are used because under certain conditions human sensitizers can be produced.

Semi-polar surfactants useful herein include water-soluble amine oxides containing one alkyl moiety of from about 10 to 28 carbon atoms and 2 moieties selected from the group consisting from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

The instant granular compositions can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorous builder compounds are disclosed in U.S. Pat. Nos. 3,159,581; 3,213,030; 3,422,021; 3,422,137; 3,400,176; 3,400,148; 4,019,998 and 4,019,999, incorporated herein by reference. Sodium tripolyphosphate is an especially preferred, water-soluble inorganic builder herein.

Non-phosphorous containing sequestrants can also be selected for use herein as detergency builders. Specific examples of non-phosphorus, inorganic builder ingredients include water-soluble inorganic carbonate, bicarbonate, borate and silicate salts. The alkali metal, e.g., sodium and potassium, carbonates, bicarbonates, borates (Borax) and silicates are particularly useful herein.

Water-soluble, organic builders are also useful herein. For example, the alkali metal, ammonium and substituted ammonium polyacetates, carboxylates, polycarbonates, succinates, and polyhydroxysulfonates are useful builders in the present compositions and processes. Specific examples of the polyacetate and polycarboxylate builder salts include sodium potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, the mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product.

Specific examples of materials capable of forming the water-insoluble reaction product include the water-soluble salts of carbonates, bicarbonates, sesquicarbonates, silicates, aluminates and oxylates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites," especially Zeolite A, hydrated Zeolites A, X, and B materials, are useful for this builder/softener purpose. A description of zeolite materials and a method of preparation appears in Milton, U.S. Pat. No. 2,882,243, issued Apr. 14, 1959, incorporated herein by reference.

It is recognized that any of the foregoing builder materials can be used separately or as mixtures. Mixtures of builders which can be used in the present detergent composition can be taken from the complex aluminosilicates, i.e., the naturally occurring and synthetic zeolites, especially Zeolite A, hydrated Zeolites A, X, and B, the water soluble salts of pyrophosphates or tripolyphosphates, e.g. sodium and potassium salts, and the water soluble salts of silicates, e.g. sodium and potassium salts.

The detergent bleaching compositions used in the present invention may also contain other adjunct materials commonly used in detergent compositions. Examples of such components include various soil-suspending agents, such as methylcellulose, corrosion inhibitors, dyes, fillers, such as sodium sulfate and silica, optical brighteners, suds suppressing agents, germicides, pH adjusting agents, antiwrinkling agents, enzymes, enzyme stabilizing agents, perfumes and the like.

COMPOSITION PREPARATION

The detergent compositions of the present invention can be prepared in conventional ways, e.g., by mixing or by adding the surfactant, the builder, and diluents as well as other compatible ingredients to an aqueous slurry, thoroughly mixing (crutching) the composition, and then spray drying. The above detergent compositions are then admixed with the DBMgH particles giving the resulting particulate detergent composition. To the resulting particulate detergent composition, polyethylene glycol, mineral oil, and other suitable nonionic compounds and coconut alkyl ethoxylated sulfate may be added as a spray-on for dust control.

TEST METHODS

The following standardized test is used to determine the efficiency of the detergent compositions.

Whitening performance is determined by using soiled T-shirts (dingy) cut into swatches. The swatches are numbered and washed with the test product at a temperature of 100° F. The equivalent of 1¼ cups/17 gallons (8.5 grams) of detergent product is added to a mini-washer of 1.5 gallons capacity. The water hardness is set at any convenient level typically 0.0 to 12.0 grains per gallon as calcium carbonate. The water hardness itself is a mixture of calcium and magnesium in a respective weight ratio of 3:1. The wash cycle is 10 minutes.

Grease/oil removal is determined by using the same procedure as above with grease and oil stained swatches replacing the dingy T-shirt swatches.

After washing, the swatches from each treatment are paired with a swatch from another treatment. The swatches are graded visually on a 0–4 scale by expert graders. The method used is that of paired comparisons which is cited in "*Techniques of Attitude Scale Construction,*" Allan L. Edwards, 1957, Appleton-Century-Crofts, Inc. The comparative method consists of comparing two swatches at a time and giving grades to each swatch based on the following scale:

0 — No difference
1 — A slight difference
2 — A moderate difference
3 — A large difference
4 — A very large difference The scores of the combined panel members are analyzed to produce a numerical score, in Panel Score Units, for each fabric on a scale based on the end results. A statistical analysis of variance is also done to insure reproducability of these scores. The grades obtained are normalized to the low benchmark of detergent plus perborate bleach.

The following are examples of the present invention.

EXAMPLE I

Compositions A, B, C, D, and E were prepared to measure whiteness performance.

| | A | B | C | D | E |
|---|---|---|---|---|---|
| Sodium alkyl (11.8 average) benzene sulfonate | 6.6% | 6.6% | 6.6% | 6.6% | 6.6% |
| Sodium tallow alcohol sulfate | 5.2 | 5.2 | 5.2 | 5.2 | 5.2 |
| Sodium alkyl ($C_{14}$-$C_{16}$ triethoxy sulfate | 5.2 | 5.2 | 5.2 | 5.2 | 5.2 |
| Sodium pyrophosphate | 11.7 | 11.7 | 11.7 | 11.7 | 11.7 |
| Sodium silicate ($SiO_2$:$Na_2O$ 3.2:1) | 12.0 | 12.0 | 12.0 | 12.0 | 12.0 |
| Sodium aluminosilicate (hydrated zeolite A, ~ 3μm diameter) | 15.0 | 15.0 | 15.0 | 15.0 | 15.0 |
| Sodium hexametaphosphate/ PEG (1:1) | 1.8 | 1.8 | 1.8 | 1.8 | 1.8 |
| Sodium perborate (8.1 ppm $AvO_2$) | 5.5 | — | — | — | — |
| DBMgH (random particle size - 50 ppm $AvCl_2$) | — | 6.67 | — | — | — |
| (through 77 μm screen on a 45 micron screen) | — | — | 6.67 | — | — |
| (through 45 μm screen on a 10 μm screen) | — | — | — | 6.67 | — |
| Clorox liquid (200 ppm $AvCl_2$) | — | — | — | — | recom-mended usage |
| Minors and moisture to 100% | | | | | |

The above compositions were tested for whiteness performance under the following conditions —

2 grains/gallon 3:1 Ca/Mg Hardness
100° F. 1¼ cups equivalent (1500 ppm)

The above compositions B, C, and D when added to solution at a concentration of 1500 ppm detergent give a pH solution of 9.9, 8.7, and 9.7, respectively.

Multicycle testing of the composition via the test method previously described gave the following fourth cycle results in Panel Score Units (PSU):

| Composition | P SU |
|---|---|
| A | 0.0 |
| B | 0.5 |
| C | 0.7 |
| D | 0.8 |
| E | 0.9 |
| Least significant difference (95% confidence limit) | 0.4 |

The compositions of the present invention, C and D, clean better than a similar composition B which contains the larger particle size DBMgH.

EXAMPLE II

Compositions F, G, H, I and J were prepared with G, H, I including DBMgH particles of random sizes in diameter (160 micron nominal).

| | F | G | H | I | J |
|---|---|---|---|---|---|
| Sodium alkyl (11.8 average) benzene sulfonate | 6.6% | 6.6% | 6.6% | 6.6% | 6.6% |
| Sodium tallow alcohol sulfate | 5.2 | 5.2 | 5.2 | 5.2 | 5.2 |
| Sodium alkyl ($C_{14}$-$C_{16}$) triethoxy sulfate | 5.2 | 5.2 | 5.2 | 5.2 | 5.2 |
| Sodium pyrophosphate | 11.7 | 11.7 | 11.7 | 11.7 | 11.7 |
| Sodium silicate ($SiO_2$:$Na_2O$ 3.2:1) | 12.0 | 12.0 | 12.0 | 12.0 | 12.0 |
| Sodium aluminosilicate (hydrated zeolite A ~ 3μm diameter) | 15.0 | 15.0 | 15.0 | 15.0 | 15.0 |
| Sodium hexametaphosphate/ polyethylene glycol (1:1) | 1.8 | 1.8 | 1.8 | 1.8 | 1.8 |
| Sodium perborate (8.1 ppm AvO) | 5.5 | — | — | — | — |
| DBMgH (20 ppm $AvCl_2$) | — | 2.7 | — | — | — |
| (50 ppm $AvCl_2$) | — | — | 6.67 | — | — |
| (80 ppm $AvCl_2$) | — | — | — | 10.7 | — |
| Clorox (200 ppm $AvCl_2$) | — | — | — | — | recom-mended usage |
| Minors and moisture to 100% | | | | | |

The above compositions were tested for whiteness performance under the following conditions —

6 grains/gallon 3:1 Ca/Mg hardness
100° F., 1¼ cups/17 gallons equivalent

In a one cycle dingy fabric clean-up the following results in PSU were obtained with the random size distribution of DBMgH particles:

| Composition | PSU |
|---|---|
| F | 0 |
| G | .3 |
| H | .4 |
| I | .5 |
| J | 1.2 |
| LSD | .5 |

EXAMPLE III

Compositions K, L, M, N, and O were prepared with K and O exactly like F and J. Composition L, M, and N are exactly like G, H, and I but contain DBMgH particles of 6–12 microns in diameter.

The above compositions were tested under the following conditions —

4 grains/gallon 3:1 Ca/Mg hardness
100° F., 1¼ cups/17 gallons equivalent

In a one cycle dingy fabric clean-up the following results in PSU were obtained:

| Composition | PSU Test I | PSU Test II |
|---|---|---|
| K | 0 | 0 |
| L | 0.8 | 0.8 |
| M | 0.8 | 1.0 |
| N | 0.9 | 1.3 |
| 0 | 1.3 | 1.5 |
| LSD | 0.5 | 0.6 |

The compositions of the present invention (L, M, and N) show good cleaning performances in relation to perborate and Clorox bleach, but also better performance in relation to the previous Example containing larger diameter size DBMgH particles.

EXAMPLE IV

When, in the above Example, the following are substituted for the detergent surfactant on a part for part basis, substantially equivalent results are obtained:

P. 5.2% Neodol 45-7, 11.8% sodium alkyl (11.8 average) benzene sulfonate
Q. 17% $C_{14}$–$C_{16}$ alkane $SO_3Na$
R. 10% sodium alkyl (11.8 average) benzene sulfonate, 7% $C_{14}$–$C_{16}$ alkane $SO_3Na$
S. 17% $C_{14.8}$ HAPS (3-N-14.8 alkyl N,N-dimethyl ammonio)2-hydroxy propane-1-sulfonate
T. 5% HAPS (as in S) 12% Neodol 45-7
U. 5% sodium 3-(dodecylamino) propane-1-sulfonate, 12% trisodium alkyl (11.8 average) benzene sulfonate

EXAMPLE V

Compositions V, W, X, and Y were prepared to test their grease/oil removal efficacy —

| | V | W | X | Y |
|---|---|---|---|---|
| Sodium alkyl (11.8 average) benzene sulfonate | 6.6% | 6.6% | 6.6% | 6.6% |
| Sodium tallow alcohol sulfate sulfate | 5.2 | 5.2 | 5.2 | 5.2 |
| Sodium pyrophosphate | 11.7 | 11.7 | 11.7 | 11.7 |
| Sodium silicate ($SiO_2$:$Na_2O$ 3.2:1) | 12.0 | 12.0 | 12.0 | 12.0 |
| Sodium aluminosilicate (hydrated zeolite A, 3μm diameter) | 15.0 | 15.0 | 15.0 | 15.0 |
| Sodium hexametaphosphate: PEG (1:1) | 1.8 | 1.8 | 1.8 | 1.8 |
| Sodium perborate (8.1 ppm AVO) | 5.5 | — | — | — |
| DBMgH random particle size (50 ppm $AvCl_2$) | — | 6.67 | — | — |
| (80 ppm $AvCl_2$) | — | — | 10.7 | — |
| Clorox liquid (200 ppm $AvCl_2$) | — | — | — | recommended usage |

The above compositions were tested for grease/oil removal efficacy under the following conditions:

8 grains/gallon 3:1 Ca/Mg
100° F., 1¼ cups/17 gallons equivalent

In a 10 minute wash cycle the following results in Panel Score Units (PSU) were obtained:

| Composition | PSU |
|---|---|
| V | 0.0 |
| W | 0.1 |
| X | 0.0 |
| Y | 0.1 |
| LSD (95% confidence limits) | 0.2 |

Compositions containing the random size DBMgH particles show little improvement in grease/oil removal.

EXAMPLE VI

Compositions 1, 2, 3, and 4 were prepared to test their grease/oil removal efficacy. Compositions 1 and 4 are exactly like V and Y, respectively. Compositions 2 and 3 are exactly like W and X except that 2 and 3 utilize very small DBMgH particles of approximately 3μm in the compositions.

Under the test conditions used in Example V the following results were obtained in Panel Score Units (PSU):

| Composition | PSU |
|---|---|
| 1 | 0.0 |
| 2 | 0.5 |
| 3 | 0.4 |
| 4 | 0.3 |
| LSD (95% confidence limits) | 0.2 |

Results obtained in this Example show the added benefit of grease/oil removal found when smaller particle sizes are used.

EXAMPLE VII

When, in the above Examples, the following zeolites are substituted for the chosen aluminosilicate on a part for part basis, substantially equivalent results are obtained:

5. 12% hydrated zeolite X ~ 3μm diameter,
6. 12% hydrated zeolite B ~ 3μm diameter.

EXAMPLE VIII

The following composition, 7, can be made to obtain equivalent results as in the previous Examples:

| | |
|---|---|
| Sodium alkyl (11.8) benzene sulfonate | 6.6% |
| Sodium tallow alcohol sulfate | 5.2 |
| Sodium alkyl ($C_{14}$–$C_{16}$) triethoxy sulfate | 5.2 |
| Sodium tripolyphosphate | 24.4 |
| Sodium silicate ($SiO_2$:$Na_2O$ 2.0:1) | 11.3 |
| DBMgH (50% $AvCl_2$) (particle size in 6–12 microns range) | 6.67 |
| Sodium ($C_{12}$–$C_{13}$) alkyl $ethoxy_{6.0}$ sulfate | 2.0 |

-continued

| | |
|---|---|
| Minors and moisture to 100% | |

EXAMPLE IX

When, in the above Example, the following are substituted for the spray-on on a part for part basis, substantially equivalent results are obtained:

8. 2.0% mineral oil (White Heavy Domestic, 335–350 Saybolt Units),
9. 2.0% polyethylene glycol.

EXAMPLE X

Composition 10 can be prepared to get substantially equivalent results as obtained above with the smaller particle size:

| | |
|---|---|
| Sodium alkyl (11.8 average) benzene sulfonate | 17.0% |
| Sodium aluminosilicate (hydrated zeolite A, ~ 3μm diameter) | 25.0 |
| Sodium pyrophosphate | 12.0 |
| Sodium bicarbonate | 14.0 |
| DBMgH (50% $AvCl_2$) (particle size less than 88μm) | 6.7 |
| Sodium hexametaphosphate/PEG (1:1) | 1.8 |
| Sodium silicate ($SiO_2$:$Na_2O$ 3.2:1) | 10.0 |
| Minors and water to 100% | |

When the composition is added to water at a concentration of 1500 ppm detergent a pH of 9.3 should result.

What is claimed is:

1. A particulate detergent composition consisting essentially of
   (a) from 5 to 50% by weight of an organic detergent surfactant;
   (b) from 0 to 90% by weight of a detergency builder and mixtures thereof;
   (c) from 1 to 50% by weight of the bleaching agent dibasic magnesium hypochlorite having an average particle diameter of less than about 88 microns; and
   (d) from 0 to about 50% of a buffering agent, there being at least 1% of said buffering agent where the dibasic magnesium hypochlorite particle diameter is greater than about 45μm to give compositions having a pH of from about 8.0 to about 9.6 when added to water at a concentration of 1500 parts per million detergent.

2. The composition of claim 1 wherein the dibasic magnesium hypochlorite has an average particle diameter of less than 45 microns.

3. The composition of claim 2 wherein the detergency builder is selected from the group consisting of hydrated alkali metal zeolite A, zeolite X, or zeolite B, an alkali metal pyrophosphate, an alkali metal tripolyphosphate, and alkali metal silicate having an $SiO_2$:$M_2O$ ratio of from about 1.6 to about 4, and mixtures thereof.

4. The composition of claim 3 wherein the alkali metal silicate has a weight ratio $SiO_2$:$M_2O$ of about 1.6 to about 3.2.

5. The composition of claim 3 wherein the alkali metal pyrophospate is sodium pyrophosphate.

6. The composition of claim 3 wherein the builder is a mixture consisting essentially of:
   (a) from 10 to about 25% by weight of the total composition of an alkali metal pyrophosphate;
   (b) from 7 to about 15% by weight of the total composition of hydrated alkali metal zeolite A; and
   (c) from 7 to about 15% by weight of the total composition of the alkali metal silicate.

7. The composition of claim 2 wherein the organic detergent surfactant is anionic.

8. The composition of claim 7 wherein the anionic detergent is selected from the group consisting of alkyl benzene sulfonates, alkyl polyethoxy sulfates, alkyl sulfates, paraffin sulfonates, and mixtures thereof.

9. The composition of claim 8 wherein the anionic detergent composition is a mixture consisting essentially of:
   (a) from about 2 to about 20% by weight of the total composition of a $C_9$–$C_{15}$ alkali metal ammonium, or alkanolammonium alkyl benzene sulfonate;
   (b) from about 2 to about 20% by weight of the total composition of a $C_8$–$C_{16}$ alkali metal alkyl polyethoxylate sulfate, containing from one to about six ethylene oxide moieties; and
   (c) from about 2% to about 20% by weight of the total composition of a $C_8$–$C_{24}$ alkali metal, ammonium, or alkanolammonium tallow alcohol sulfate.

10. The composition of claim 8 wherein the detergency builder is selected from the group consisting of a hydrated alkali metal zeolite A, zeolite X, or zeolite B, an alkali metal pyrophosphate, an alkali metal tripolyphosphate, an alkali metal silicate having an $SiO_2$:$M_2O$ ratio of from about 1.6 to about 4.0, and mixtures thereof.

11. The composition of claim 1 wherein the dibasic magnesium hypochlorite has an average particle diameter of less than about 10 microns.

12. The composition of claim 11 wherein the detergency builder is selected from the group consisting of a hydrated alkali metal zeolite A, zeolite X, or zeolite B, an alkali metal pyrophosphate, an alkali metal tripolyphosphate, an alkali metal silicate having an $SiO_2$:$M_2O$ ratio of from about 1.6 to about 4.0, and mixtures thereof.

13. The composition of claim 11 wherein the anionic detergent is selected from the group consisting of a $C_9$–$C_{15}$ alkali metal alkyl benzene sulfonate, a $C_8$–$C_{16}$ alkali metal alkyl polyethoxylate sulfate, containing from one to about six ethylene oxide moieties, a $C_8$–$C_{24}$ alkali metal tallow alcohol sulfate, a $C_8$–$C_{20}$ alkali metal paraffin sulfonate, and mixtures thereof.

14. The composition of claim 13 wherein the detergency builder is selected from the group consisting of a hydrated alkali metal zeolite A, zeolite X, or zeolite B, an alkali metal pyrophosphate, an alkali metal tripolyphosphate, an alkali metal silicate having an $SiO_2$:$M_2O$ ratio of from 1.6 to about 4.0, and mixtures thereof.

15. The composition of claim 1 wherein the dibasic magnesium hypochlorite has an average particle diameter in the range 6–12 microns.

16. The composition of claim 15 wherein the detergency builder is selected from the group consisting of a hydrated alkali metal zeolite A, zeolite X, or zeolite B, an alkali metal pyrophosphate, an alkali metal tripolyphosphate, an alkali metal silicate having an $SiO_2$:$M_2O$ ratio of from about 1.6 to about 4.0, and mixtures thereof.

17. The composition of claim 15 wherein the anionic detergent is selected from the group consisting of a $C_9$–$C_{19}$ alkali metal alkyl benzene sulfonate, a $C_8$–$C_{16}$ alkali metal polyethoxylate sulfate, containing from one to about six ethylene oxide moieties, a $C_8$–$C_{24}$ alkali metal tallow alcohol sulfate, a $C_8$–$C_{20}$ alkali metal paraffin sulfonate, and mixtures thereof.

18. The composition of claim 17 wherein the detergency builder is selected from the group consisting of a hydrated alkali metal zeolite A, zeolite X, or zeolite B, an alkali metal pyrophosphate, an alkali metal tripolyphosphate, an alkali metal silicate having an $SiO_2:M_2O$ ratio of from 1.6 to about 4.0, and mixtures thereof.

19. The composition of claim 1 wherein the dibasic magnesium hypochlorite has an average particle diameter in the range of 45–88 microns.

20. The composition of claim 19 wherein the buffering agent is sodium bicarbonate.

21. The composition of claim 20 wherein the detergency builder is selected from the group consisting of a hydrated alkali metal zeolite Z, zeolite X, or zeolite B, an alkali metal pyrophosphate, an alkali metal tripolyphosphate, an alkali metal silicate having an $SiO_2:M_2O$ ratio of from 1.6 to about 4, and mixtures thereof.

22. The composition of claim 20 wherein the anionic detergent is selected from the group consisting of a $C_9$–$C_{15}$ alkali metal alkyl benzene sulfonate, a $C_8$–$C_{16}$ alkali metal polyethoxylate sulfate containing from one to about six ethylene oxide moieties, a $C_8$–$C_{24}$ alkali metal tallow alcohol sulfate, a $C_8$–$C_{20}$ alkali metal paraffin sulfonate, and mixtures thereof.

23. The composition of claim 22 wherein the detergency builder is selected from the group consisting of a hydrated alkali metal zeolite A, zeolite X, or zeolite B, and alkali metal pyrophosphate, an alkali metal tripolyphosphate, and alkali metal silicate having $SiO_2:M_2O$ ratio of about 1.6 to about 4.0, and mixtures thereof.

24. The composition of claim 20 wherein the buffering agent sodium bicarbonate is present in such quantity to give an initial pH in solution of from 8.5 to about 9.5.

25. The composition of claim 24 wherein the detergency builder is selected from the group consisting of a hydrated alkali metal zeolite A, zeolite X, or zeolite B, and alkali metal pyrophosphate, an alkali metal tripolyphosphate, an alkali metal silicate having $SiO_2:M_2O$ ratio of about 1.6 to about 4.0, and mixtures thereof.

26. The composition of claim 24 wherein the anionic detergent is selected from the group consisting of alkyl benzene sulfonates, alkyl polyethoxy sulfates, and alkyl sulfates, paraffin sulfonates, and mixtures thereof.

27. The composition of claim 26 wherein the detergency builder is selected from the group consisting of a hydrated alkali metal zeolite A, zeolite X, or zeolite B, and alkali metal pyrophosphate, an alkali metal tripolyphosphate, and alkali metal silicate having $SiO_2:M_2O$ ratio of about 1.6 to about 4.0, and mixtures thereof.

* * * * *

UNITED STATES PATENT AND TRADEMARK OFFICE

CERTIFICATE OF CORRECTION

PATENT NO. : 4,123,377

DATED : October 31, 1978

INVENTOR(S) : Christopher R. Davey et al

It is certified that error appears in the above-identified patent and that said Letters Patent are hereby corrected as shown below:

Column 2, line 16, "1413F" should be -- 14134F --.

Column 3, line 20, "The FIG." should be -- Figure 1 --.

Column 4, line 26, "DBHgH" should be -- DBMgH --.

Column 4, line 41, "DBHgH" should be -- DBMgH --.

Column 5, line 40, after "12" should be -- carbon --.

Column 7, line 31, "the" should be -- and --.

Column 11, line 45 (Example V), omitted -- Sodium alkyl ($C_{14}$-$C_{16}$) triethoxy -- then -- 5.2 -- under Columns V, W, X and Y.

Signed and Sealed this

Nineteenth Day of June 1979

[SEAL]

Attest:

RUTH C. MASON
Attesting Officer

DONALD W. BANNER
Commissioner of Patents and Trademarks